United States Patent [19]

Toncelli

[11] Patent Number: 4,597,225

[45] Date of Patent: Jul. 1, 1986

[54] INTERCHANGEABLE SUPPORT DISC FOR DIAMOND-BEARING PLATES OF CIRCULAR MILLING CUTTERS

[76] Inventor: Marcello Toncelli, Via Giovanni XXIII, Bassano Del Grappa (Vicenza), Italy

[21] Appl. No.: 750,547

[22] Filed: Jul. 1, 1985

Related U.S. Application Data

[63] Continuation of Ser. No. 551,684, Nov. 14, 1983, abandoned.

[30] Foreign Application Priority Data

Nov. 22, 1982 [IT] Italy ..... 6444582[U]

[51] Int. Cl.[4] ..... B24B 7/10

[52] U.S. Cl. ..... 51/209 R; 125/5

[58] Field of Search ..... 51/209 R; 125/5

[56] References Cited

U.S. PATENT DOCUMENTS

| | | | |
|---|---|---|---|
| 1,526,953 | 2/1925 | Beth | 51/209 R |
| 2,442,129 | 5/1948 | Hollstrom | 51/209 R |
| 2,867,063 | 1/1959 | Metzger | 51/206 R |
| 2,980,098 | 4/1961 | Wayland | 51/209 R |
| 3,026,655 | 3/1962 | Osenberg | 51/209 R |
| 3,121,982 | 2/1964 | Miller | 51/209 R |
| 3,318,053 | 5/1967 | Miller | 51/209 R |
| 3,664,068 | 5/1972 | Metzger | 51/209 R |
| 3,745,719 | 7/1973 | Oswald | 51/209 R |

*Primary Examiner*—Harold D. Whitehead

*Attorney, Agent, or Firm*—Bucknam and Archer

[57] ABSTRACT

An interchangeable support disc for diamond-bearing plates used in circular milling cutters for the planing of stones, marbles, granite and the like comprises a plurality of such plates mounted on discs which are in turn connected by screws to a circular support member so that the discs may easily be replaced. The parallelepipedal shape of the diamond bearing plates is particularly advantageous for the polishing of marble, granite, and similar materials because it contributes to the stability of the device. The screws are located out of center of the discs and closer to the center of the circular support member.

1 Claim, 3 Drawing Figures

INTERCHANGEABLE SUPPORT DISC FOR DIAMOND-BEARING PLATES OF CIRCULAR MILLING CUTTERS

This is a continuation of application Ser. No. 551,684, filed Nov. 14, 1983 and now abandoned.

BACKGROUND OF THE INVENTION

In the present invention there is provided an interchangeable support disc for diamond-bearing plates which are used in the circular milling cutters utilised in the planing of stones, marbles and granites.

As is known, the wearing of the diamond-bearing plates which act as working tools in circular milling cutters for the planing of stones, marbles and granites gives rise to a hard and costly operation for the substitution of the said plates, resulting in long periods of halting of the machine.

In contrast, with the adoption of the present invention each diamond-bearing plate is mounted on a base disc which is easily interchangeable in that it is fixed to the rotating disc of the machine by means of a screw.

BRIEF DESCRIPTION OF THE DRAWINGS

The invention is illustrated in the accompanying sheet of drawings, wherein.

Figure 1:
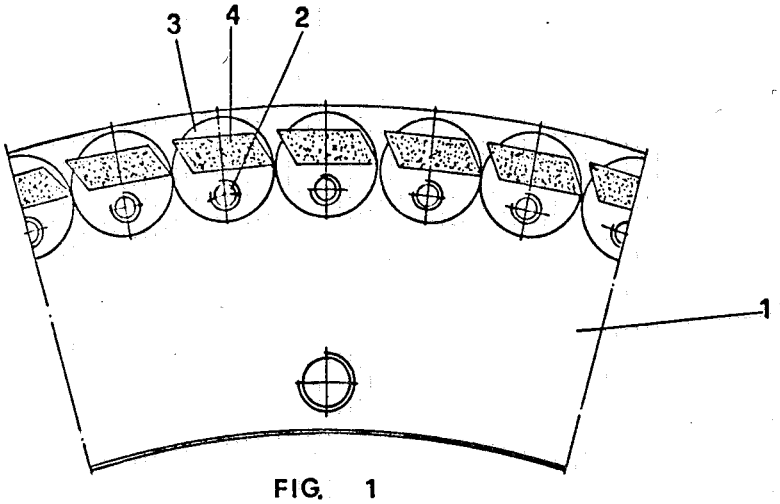
FIG. 1 represents a partial front view of a portion of a rotating ring of a diamond-bearing milling cutter, provided with base discs in accordance with the Model.

From FIG. 1 it will be noted that the ring 1, which constitutes the support member for the tools in a smoothing milling cutter for stones, marbles and granites, is provided with screws 2 which support the discs 3 on each of which there is welded the diamond-bearing plate 4 which acts as the working tool The discs are of a parallelopipedal shape.

Figure 2:
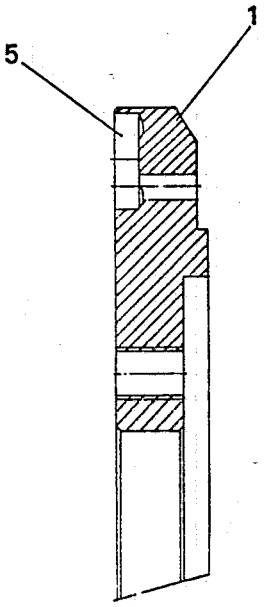
FIG. 2 shows the same base ring, in a partial view, radially sectioned.
Figure 3:
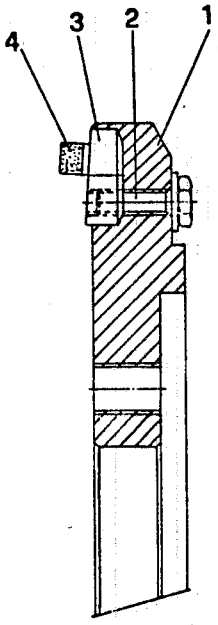
FIG. 3 shows the same, with a disc mounted in accordance with the Model.

From FIGS. 2 and 3 it will be noted that each disc 3, on which is welded the diamond-bearing plate 4, is mounted in a recess 5 of circular section, which holds it firmly anchored after the screw 2 has been inserted therein.

The advantages presented by the adoption of this Model are obvious, in that the replacement of the diamond-bearing plate 4 is very much facilitated by the presence of the support disc 3 fixed to the ring 1 by means of the screw 2, which disc can be substituted with ease, together with the plate welded to it, when the latter has become worn.

The operation of substitution can be carried out directly on the milling machine, which makes not only the work of substitution more simple but also more rapid and less costly.

I claim:

1. A circular milling cutter for stone, marble, granite and the like, which comprises:

(a) a circular support member for rotating about a center and (1) having an annular array of circular recesses (5);

(b) a circular disc (3) mounted on said circular support rotatable member (1) in each said recess (5);

(c) a screw (2) which connects each said discs to said circular support rotating member; said screw passing perpendicularly to the plane of each of said discs;

(d) a diamond bearing plate (4) mounted on each of said discs (3), said plate being of parallelopipedal shape, wherein said screw is located closer to the center of said circular support rotating member (1) than said diamond-bearing plate, said screw being located eccentrically with respect to the center of each of said discs (3), and said diamond-bearing plate being welded to said disc.

* * * * *